US007650766B2

(12) United States Patent
Shaffer

(10) Patent No.: US 7,650,766 B2
(45) Date of Patent: Jan. 26, 2010

(54) APPARATUS AND METHODS FOR RINSING WASHING MACHINES

(75) Inventor: Timothy Scott Shaffer, La Grange, KY (US)

(73) Assignee: General Electric Company, Schenectady, NY (US)

( * ) Notice: Subject to any disclaimer, the term of this patent is extended or adjusted under 35 U.S.C. 154(b) by 445 days.

(21) Appl. No.: 10/630,251

(22) Filed: Jul. 30, 2003

(65) Prior Publication Data

US 2005/0022317 A1 Feb. 3, 2005

(51) Int. Cl.
*D06F 39/02* (2006.01)

(52) U.S. Cl. ..... 68/17 R; 68/207

(58) Field of Classification Search ..... 68/12.02, 68/207, 12.19, 12.21, 12.05
See application file for complete search history.

(56) References Cited

U.S. PATENT DOCUMENTS 3,223,108 A * 12/1965 Martz, Jr. ..... 137/93
3,707,856 A * 1/1973 Niewyk et al. ..... 68/12.03
4,561,471 A 12/1985 Diaz
4,733,798 A * 3/1988 Brady et al. ..... 222/23
4,756,321 A * 7/1988 Livingston et al. ..... 134/56 D
5,307,650 A 5/1994 Mertz
5,315,847 A * 5/1994 Takeda et al. ..... 68/12.02
5,573,677 A 11/1996 Dembrosky
5,743,115 A 4/1998 Hashimoto
6,810,732 B2 * 11/2004 Shon ..... 73/304 R

FOREIGN PATENT DOCUMENTS

GB 2 052 251 * 5/1980
GB 2 266 898 * 11/1993
JP 6-218183 * 8/1994
JP 8-141272 * 6/1996

OTHER PUBLICATIONS

European Patent Office 0 686 721 Jun. 1994.*

* cited by examiner

*Primary Examiner*—Frankie L Stinson
(74) *Attorney, Agent, or Firm*—George L. Rideout, Esq.; Armstrong Teasdale LLP

(57) ABSTRACT

A washing machine is provided. The washing machine includes a tub, a sensor operatively coupled to the tub and configured to sense a conductivity of a fluid in the tub and a controller operatively coupled to the sensor for controlling an amount of the fluid in the tub based on the conductivity of the fluid.

19 Claims, 6 Drawing Sheets

APPARATUS AND METHODS FOR RINSING WASHING MACHINES

BACKGROUND OF THE INVENTION

This invention relates generally to washing machines, and, more particularly, to methods and apparatus for rinsing washing machines.

Washing machines typically include a cabinet that houses an outer tub for containing wash and rinse water, a perforated clothes basket within the tub, and an agitator within the basket. A drive and motor assembly is mounted underneath the stationary outer tub to rotate the clothes basket and the agitator relative to one another, and a pump assembly pumps water from the tub to a drain to execute a wash cycle.

Traditionally, rinse portions of wash cycles include a deep-fill process wherein articles in the clothes basket are completely submerged in water and the water is agitated. As such, a large amount of water mixes with detergent remaining in the clothes after they are washed. While the concentration of detergent in the water is relatively small, a large amount of detergent can be removed from the clothes due to the large amount of water involved. It has become increasingly desirable, however, to reduce water consumption in washing operations.

At least some types of washing machines have reduced water consumption in rinsing operation by using re-circulating rinse water flow. In this type of system, rinse water is collected in a bottom of the tub and pumped back to spray nozzles located above the basket. The rinse water is re-circulated for a predetermined length of time before being discharged to drain. See, for example, U.S. Pat. No. 5,167,722. While such systems are effective to reduce water consumption, they increase costs of the machine by employing valves, pumps, conduits, etc. that may result in additional material and assembly costs. In addition, such systems may not decrease the amount of detergent concentrations.

BRIEF DESCRIPTION OF THE INVENTION

In one aspect, a washing machine is provided. The washing machine includes a tub, a sensor operatively coupled to the tub and configured to sense a conductivity of a fluid in the tub and a controller operatively coupled to the sensor for controlling an amount of the fluid in the tub based on the conductivity of the fluid.

In another aspect, a method for controlling the fluid level in a washing machine having a tub for holding a fluid is provided. The method includes sensing a conductivity of the fluid with a sensor during a wash cycle and rinsing the tub of the washing machine with the fluid based on the conductivity of the fluid.

In a further aspect, a control system for a washing machine is provided. The washing machine includes a tub for holding a fluid. The control system is configured to sense the conductivity of the fluid, measure an average conductivity of the fluid, and rinse based on the conductivity of the fluid.

DETAILED DESCRIPTION OF THE INVENTION

Figure 1:
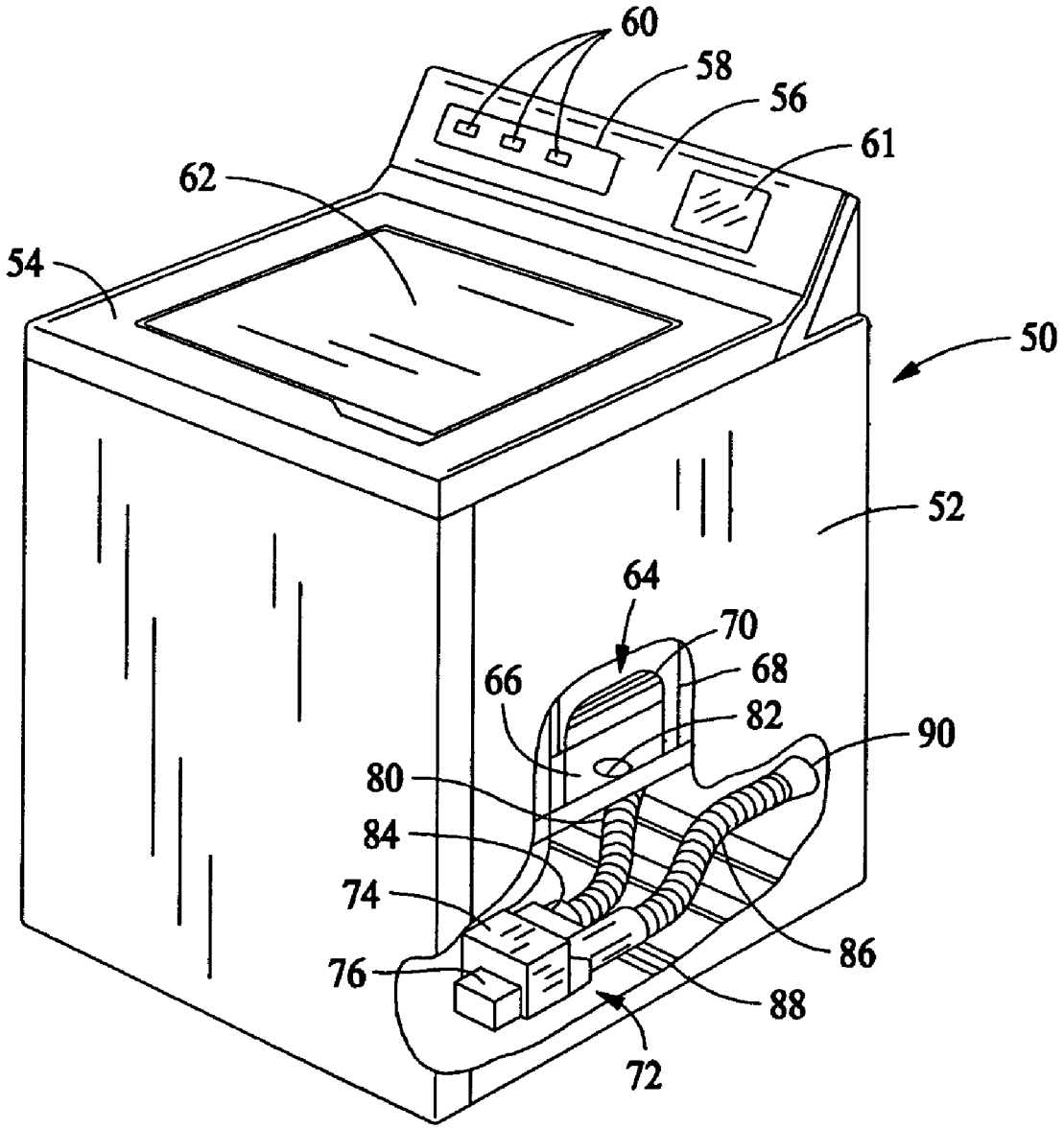
FIG. 1 is a perspective view partially broken away of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and, in one embodiment, a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 50 is a vertical axis washing machine, however, it is contemplated that the benefit of the invention accrue to other types of washing machines indicating horizontal axis machines, and, therefore, as used herein, the term washing machine refers to both vertical axis and horizontal axis machines and the term tub refer to bath a tub for a vertical axis machine and a tab for a horizontal axis machine.

Tub 64 includes a bottom wall 66 and a sidewall 68. A basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
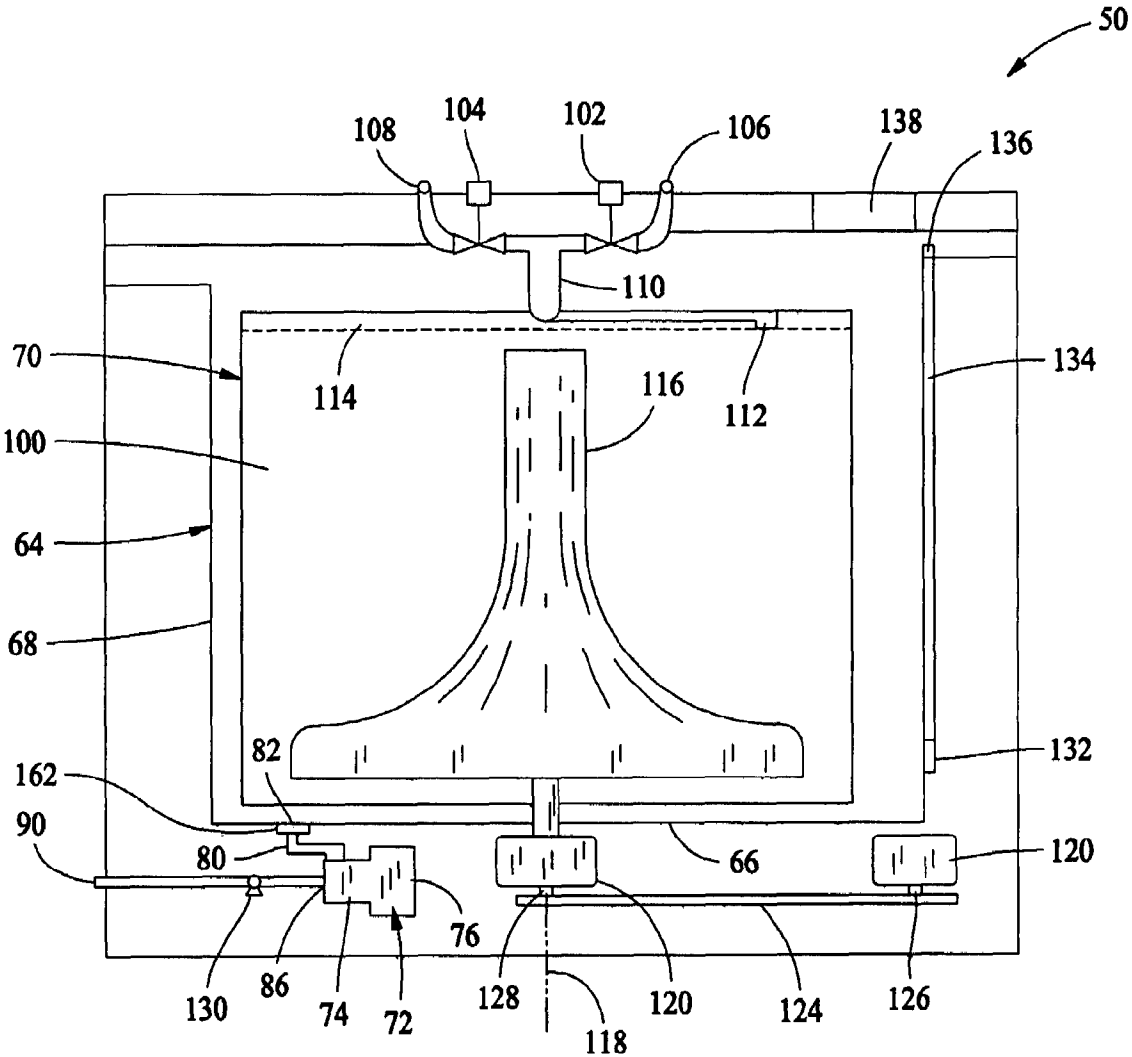
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 12 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 may be a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, transmission and clutch system 122 and belt 124 collectively are referred herein as a machine drive system.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used. In an exemplary embodiment, machine 50 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, and voltage or current phase shifts.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, clothes are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of clothes in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Clothes are then rinsed and portions of the cycle repeated, including the agitation phase, depending on the particulars of the wash cycle selected by a user.

Figure 3:
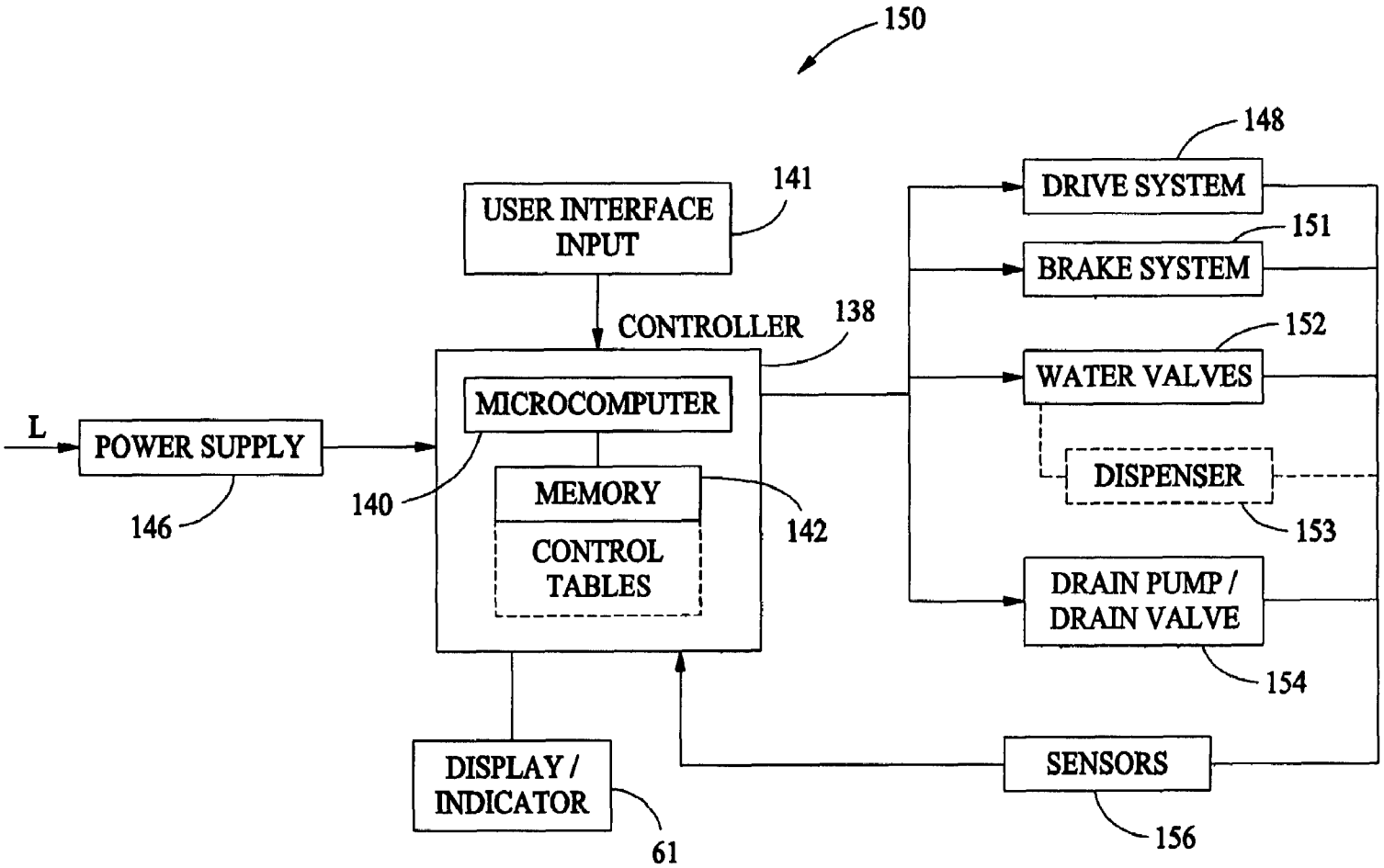
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Microcomputer 140 is programmed to perform functions described herein, and as used herein, the term microcomputer is not limited to just those integrated circuits referred to in the art as microprocessor, but broadly refers to computers, processors, microcontrollers, microprocessor, programmable logic controllers, application specific integrated circuits, and other programmable circuits, and these terms are used interchangeably herein.

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120 and clutch system 122 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70.

In response to manipulation of user interface input 141 controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein. Controller 138 operates the various components of washing machine 50 in a designated wash cycle familiar to those in the art of washing machines.

Figure 4:
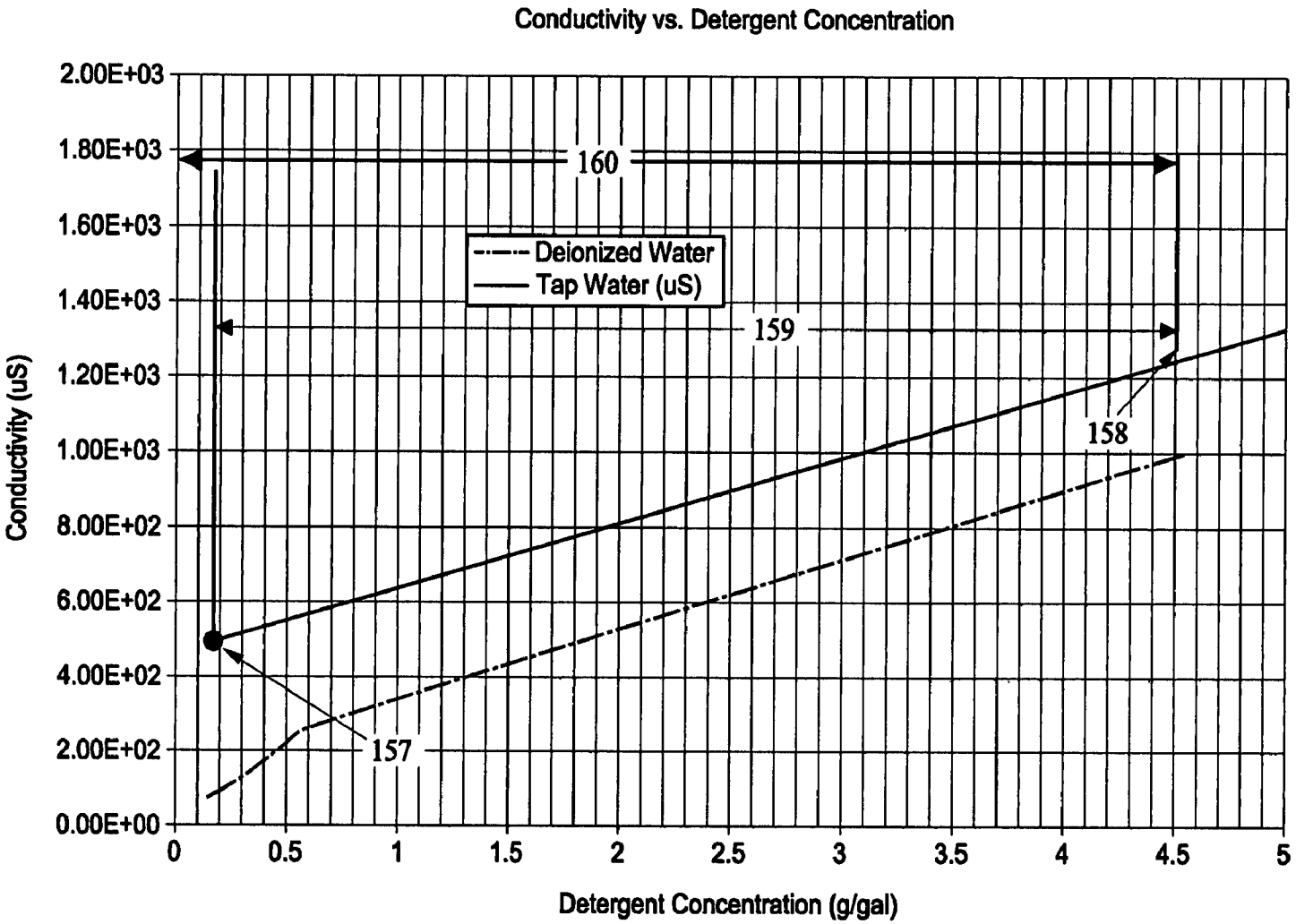
FIG. 4 is a graph of conductivity versus detergent concentration.

FIG. 4 is a graph illustrating detergent concentration level affecting a conductivity of liquid. As shown in FIG. 4, the conductivity of wash liquid is linearly proportional to detergent concentration. A first data point 157 is calculated at a start of a washing cycle based on an acceptable change percentage. In one embodiment, an acceptable change percentage is from 85% to 95%. In another embodiment, an acceptable change percentage is about 90%. A second data point 158 is calculated after a final rinse of the washing cycle. In one embodiment, second data point 158 assumes an initial 4.5 g/gal concentration. An acceptable change magnitude 159 is the difference between first and second data points 157 and 158. The difference between an initial "pristine" conductivity and the final wash liquid conductivity or second data point 158 represents a maximum or desirable achievable rinse level 160, as shown in FIG. 4.

Figure 5:
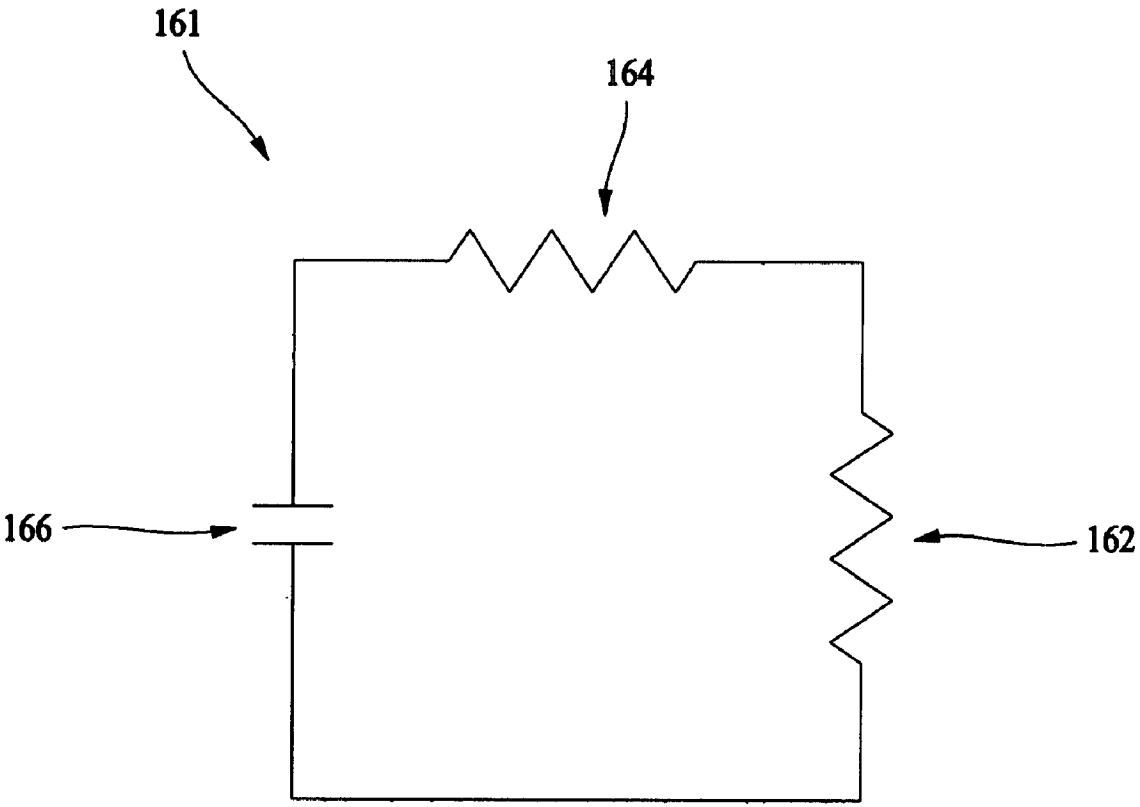
FIG. 5 is a circuit diagram of an exemplary circuit.

FIG. 5 illustrates a resistance network 161 to improve the sensitivity of the conductivity measurements. Conventional conductivity measurements may not be sensitive enough to pick up low levels of conductivity. A resistivity/conductivity sensor 162 can monitor or track the change in conductivity from a pre-wash initialization to wash to final rinse. Conductivity at low detergent concentration levels may exceed the ability of low cost conductivity sensors to accurately measure conductivity. To enhance a sensor's sensitivity at select ranges, a resistor 164 is typically placed in series with sensor 162 and energized using a low DC voltage source 166, as shown in FIG. 5. Source 166 may also be driven in a sinusoidal or square wave to deter mineral buildup on the sensor 162.

The conductivity is calculated based on the voltage difference measured across resistor 164.

$$\text{Conductivity}(\mu S) = \frac{10^6 V_{applied}}{(V_{applied} - V_{measured})R_1}$$

To measure across large variations in conductivity, such as 1000 to 0.1 u-Siemen, resistor 164 may to be as large as 6.0 mega-ohms.

Resistivity/conductivity sensor 162 is capable of sensing a change in conductivity between the wash liquid and the acceptable rinse concentration. Non-contacting toroidal conductivity technology may be used in situations with corrosion and/or soap residue buildup. At a preset change limit, such as 99% from final wash to final rinse, the rinse operation can be terminated with an optimum amount of water. The acceptance limit does not compare against an absolute conductivity measurement, but rather against the change in conductivity levels, since water purity levels, contaminants, soap brands, clothing, etc all have a bearing on the absolute conductivity level of the wash/rinse solution.

Acceptable residual detergent levels can be derived based on current production performance and consumer surveys. In the case of hypersensitive individuals, rinse selections are provided as a feature to reduce residual detergent levels below normal levels. This acceptance level can then be translated back to an acceptable percentage change in conductivity between initial "pristine" conductivity and the final wash liquid conductivity, or second data point 159. Conditions with very high detergent concentration levels may utilize some consumer input to properly rinse out detergent to recommended levels.

Acceptable residual detergent levels are determined by positioning sensor 162 in contact with the wash liquid. In one embodiment, sensor 162 is positioned within tub 64. In another embodiment, sensor 162 is positioned outside tub 64. In an exemplary embodiment, acceptable residual detergent levels are determined by placing sensor 162 below tub 64 and above drain pump 72, as shown in FIG. 2. In one embodiment, sensor 162 is a corrosion/buildup resistant sensor.

Figure 6:
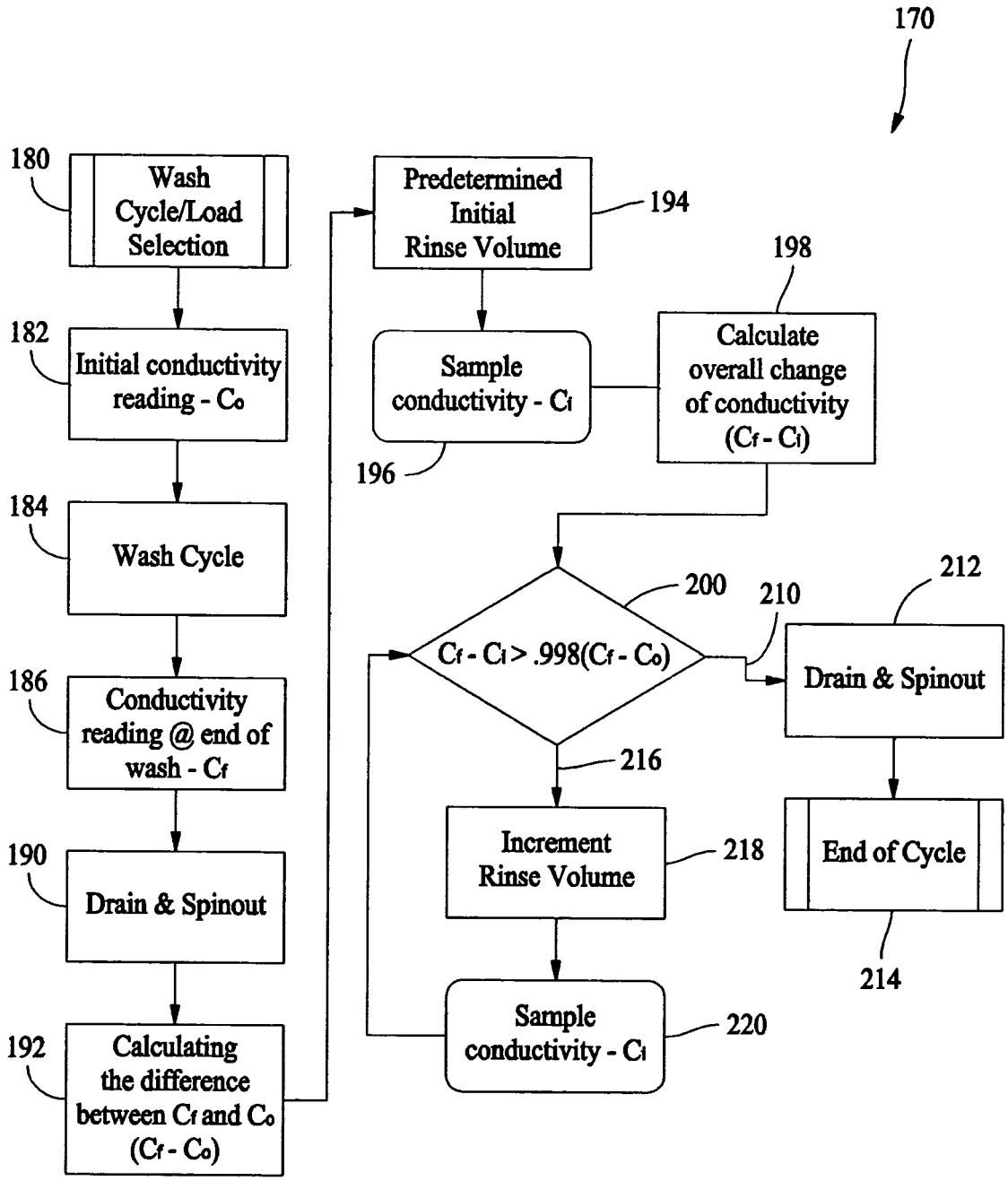
FIG. 6 is a schematic block diagram of an exemplary washing method.

FIG. 6 is a process flow diagram of an exemplary method in the form of an algorithm 170 executable by controller 138 (shown in FIG. 3) for achieving optimal fluid level, such as water level, and detergent concentrations in tub 64 (shown in FIGS. 1 and 2). Algorithm 170 may be a user selected option, such as through user manipulation of one of input selectors 60 (shown in FIG. 1), or may be automatically activated or deactivated by machine controls in various embodiments.

After sensor 162 is installed, the wash cycle is selected 180 and washer 50 is engaged to run through an initialization mode (no detergent) to measure 182 initial conductivity of the water supplied to washer 50 from either hot or cold liquid valves 102 and 104. After the initial run, running washer 50 without detergent will no longer be necessary, because the washer 50 will store the level of conductivity left in the residual water within the drain outlet 90.

Washer 50 operates 184 in a normal wash mode. Before the draining and spinning of tub 64 at the end of the wash cycle, an average fluid conductivity is measured 186. In one embodiment, the average fluid conductivity is measured over a 3-6 second sampling period. In another embodiment, the average fluid conductivity is measured over at least a 7 second sampling period. Washer 50 drains and spinouts 190 the water out of tub 64.

The difference between the initial "pristine" conductivity and the final wash liquid conductivity or achievable rinse level 160 is then calculated 192. At predetermined water levels during rinse and spinout operations 194, the average conductivity is measured 196 and the overall change of conductivity is calculated 198. The overall change of conductivity is compared 200 with achievable rinse level 160. Empirical testing under various conditions, such as water quality, soap brands, wash detergent levels, temperature, clothing material, and load quantity, may show that the initial increment of rinse water may be larger than the remaining increments. For example, it may require 5 gallons minimum to reach the rinse specification limit regardless of conditions. If the overall change of conductivity exceeds 210 an acceptable change percentage of achievable rinse level 160, then washer 50 drains and spinouts 212 the water and the rinse operations are ceased after a final spinout. If the measured change percentage does not exceed the acceptable change percentage 216, then rinse procedures are repeated 218. During the rinsing procedures 218, the water is added in a predetermined increment, such as one gallon. An average conductivity is measured 220, until the measured change exceeds the acceptable change.

In an exemplary washer, which fills the tub to pre-selected level (e.g. 15 gallons for super capacity levels), the conductivity change would be noted after some period of cloth agitation/stirring. If the change has not exceeded the acceptable limit, then water would be added in small increments until an acceptable limit is met or some upper water level limit is exceeded.

In one embodiment, a washer, such as a spray rinse washer has spray rinse cycles, whereby the conductivity levels would be monitored during each spray rinse cycle. Once the acceptable change is met, the rinse operation would be terminated. If the acceptable change is not met, the spray rinse operations are continued in small increments until the change limit is met or an upper water use limit is exceeded.

The herein describes adaptive rinse methods and apparatus actively monitors soap residue methods as opposed to conservatively over-rinsing the clothes. Additionally, the herein described adaptive rinse methods and apparatus also provides an ability to enhance rinse performance for cases where people are ultra-sensitive to soap residue.

While the invention has been described in terms of various specific embodiments, those skilled in the art will recognize that the invention can be practiced with modification within the spirit and scope of the claims.

What is claimed is:

1. A washing machine comprising:

a tub;

a resistance network comprising a sensor, a resistor, and a voltage source, said sensor positioned and configured to sense a conductivity of a fluid in said tub, said voltage source operable to provide one of a sinusoidal wave input and a square wave input to said sensor to facilitate deterring mineral buildup on said sensor; and a controller operatively coupled to said sensor and configured to control an amount of the fluid in said tub during a rinse cycle based on the conductivity of the fluid measured at an end of a wash cycle, said controller comprising a microcomputer coupled to a memory storing instructions that, when executed by the microcomputer, directs said controller to:

determine a desirable achievable rinse level;

at predetermined fluid levels during the rinse cycle, measure an average liquid conductivity;

calculate an overall change in conductivity based on the measured average liquid conductivity at each predetermined fluid level;

compare the calculated overall change in conductivity to the desirable achievable rinse level; and cease the rinse cycle when the overall change in conductivity exceeds an acceptable change percentage of the desirable achievable rinse level.

2. A washing machine according to claim 1, wherein said sensor is positioned within said tub.

3. A washing machine according to claim 1, wherein said sensor is positioned outside said tub.

4. A washing machine according to claim 1, wherein said sensor is configured to sense an initial conductivity of the fluid during the wash cycle without detergent.

5. A washing machine according to claim 4, wherein said sensor is further configured to sense a final conductivity of the fluid after the wash cycle with detergent.

6. A washing machine according to claim 5, wherein said microcomputer is programmed to determine a desirable achievable rinse level by calculating the difference between the initial conductivity and the final conductivity.

7. A washing machine according to claim 1, wherein said microcomputer is programmed to measure the conductivity of the fluid sensed by said sensor during the wash cycle without detergent and during the wash cycle with detergent.

8. A washing machine according to claim 7, wherein said microcomputer is programmed to measure the conductivity of the fluid sensed by said sensor over at least a three second period.

9. A washing machine according to claim 7, wherein said microcomputer is programmed to calculate an overall change of conductivity of the fluid.

10. A washing machine according to claim 9, wherein said microcomputer is programmed to compare the overall change of conductivity with a desirable achievable rinse level.

11. A washing machine comprising:

a tub;

a resistance network comprising a sensor, a resistor, and a voltage source, said sensor positioned and configured to sense a conductivity of a fluid in said tub; and a fluid delivery and draining assembly coupled in communication with said resistance network, said fluid delivery and draining assembly configured to control an amount of the fluid in said tub during a rinse cycle based on the conductivity of the fluid measured at an end of a wash cycle, said fluid delivery and draining assembly comprising a microcomputer coupled to a memory storing instructions that, when executed by the microcomputer, directs said fluid delivery and draining assembly to:

channel fluid into said tub;

at predetermined fluid levels within said tub during the rinse cycle, measure an average liquid conductivity;

calculate an overall change in conductivity based on the measured average liquid conductivity at each predetermined fluid level;

compare the calculated overall change in conductivity to a desirable achievable rinse level; and cease the rinse cycle when the overall change in conductivity exceeds an acceptable change percentage of the desirable achievable rinse level.

12. A washing machine according to claim 11, wherein said sensor is configured to sense an initial conductivity of the fluid during the wash cycle without detergent.

13. A washing machine according to claim 12, wherein said sensor is further configured to sense a final conductivity of the fluid after the wash cycle with detergent.

14. A washing machine according to claim 13, wherein said fluid delivery and draining assembly is configured to determine a desirable achievable rinse level by calculating a difference between the initial conductivity and the final conductivity.

15. A washing machine according to claim 11, wherein said fluid delivery and draining assembly is configured to measure the conductivity of the fluid sensed by said sensor during the wash cycle without detergent and during the wash cycle with detergent.

16. A washing machine according to claim 15, wherein said fluid delivery and draining assembly is configured to measure the conductivity of the fluid sensed by said sensor over at least a three second period.

17. A washing machine according to claim 15, wherein said fluid delivery and draining assembly is configured to calculate an overall change of conductivity of the fluid.

18. A washing machine according to claim 17, wherein said fluid delivery and draining assembly is configured to compare the overall change of conductivity with the desirable achievable rinse level.

19. A washing machine according to claim 11 wherein said voltage source is operable to provide one of a sinusoidal wave input and a square wave input to said sensor to facilitate deterring mineral buildup on said sensor.

* * * * *